US006530194B2

(12) United States Patent
Shibazaki et al.

(10) Patent No.: US 6,530,194 B2
(45) Date of Patent: Mar. 11, 2003

(54) BANDING PACKING MACHINE

(75) Inventors: Tokio Shibazaki, Kawasaki (JP); Tadashi Meguro, Kawasaki (JP); Yosikatsu Aizawa, Kawasaki (JP); Kenichi Enda, Kawasaki (JP)

(73) Assignee: Strapack Corporation, Tokyo (JP)

( * ) Notice: Subject to any disclaimer, the term of this patent is extended or adjusted under 35 U.S.C. 154(b) by 0 days.

(21) Appl. No.: 09/894,372

(22) Filed: Jun. 27, 2001

(65) Prior Publication Data

US 2002/0000078 A1 Jan. 3, 2002

(30) Foreign Application Priority Data

Jun. 29, 2000 (JP) ..... 2000-196676

(51) Int. Cl.[7] ..... B65B 11/00; B65B 13/04; B65B 13/22; B65B 13/24

(52) U.S. Cl. ..... 53/582; 53/589; 100/29; 100/32; 100/33 PB

(58) Field of Search ..... 53/582, 589; 100/26, 100/29, 32, 32 PB

(56) References Cited

U.S. PATENT DOCUMENTS 3,577,909 A * 5/1971 Takano et al. ..... 100/26
4,016,023 A * 4/1977 Takami ..... 100/33 PB
4,527,379 A 7/1985 Bartzick et al.
4,661,185 A 4/1987 Kobiella
4,850,179 A * 7/1989 Takami ..... 100/26
4,850,180 A * 7/1989 Takami ..... 100/26
4,938,009 A * 7/1990 Takami ..... 100/26
5,267,508 A * 12/1993 Yoshino ..... 100/26
5,379,576 A * 1/1995 Koyama ..... 100/32
5,414,980 A * 5/1995 Shibazaki et al. ..... 100/26
5,657,612 A * 8/1997 Renz et al. ..... 100/32

* cited by examiner

*Primary Examiner*—Anthony D. Stashick
(74) *Attorney, Agent, or Firm*—Webb Ziesenheim Logsdon Orkin & Hanson, P.C.

(57) ABSTRACT

It is an object to provide a banding packing machine capable of easily processing a right presser member, a left presser member and a middle presser member, reducing the number of parts and readily carrying out attachment with high precision. A drum portion of at least a middle presser member (24) provided in a central part in a right presser member (22), a left presser member (23) and the middle presser member (24) has a sectional shape of an almost track including a pair of circular arc portions **(26*a*, 26*d*) opposed to each other and a pair of straight portions (26*c*, 26*d*) opposed to each other, and one of ends of each of drum portions (27, 28) in the right presser member (22) and the left presser member (23) which are opposed to the straight portions (26*c*, 26*d*) of the middle presser member (24)** is formed rectilinearly.

2 Claims, 10 Drawing Sheets

PRIOR ART

BANDING PACKING MACHINE

BACKGROUND OF THE INVENTION

1. Field of the Invention

The present invention relates to a banding packing machine and more particularly to a banding packing machine capable of transmitting, with high precision, an operation of a cam mechanism provided to carry out cutting, welding and the like for binding a band.

2. Description of the Related Art

In an automatic or semi-automatic banding packing machine, a band led from a band reel is wound upon an object to be packed and is then clamped, and subsequently, is returned to the band feeding side and is tightened. Thereafter, a bound portion is melted by a heater almost simultaneously with the cutting and is bonded by means of a press. The timing of these operations is usually made by means of a cam mechanism.

FIG. 11 shows the structure of a control portion for carrying out an operation such as clamp, welding, cutting and the like for a tip portion of a band based on the cam mechanism in a conventional banding packing machine.

In the control portion, a right presser member 5, a left presser member 6 and a middle presser member 7 are accommodated in a support block 52 in the vicinity of a face where an object to be packed is to be provided, and are supported on a pair of fixed plates 12 and 13 through a screw member 54 or the like.

The right presser member 5, the left presser member 6 and the middle presser member 7 have such a structure that rollers 14, 15 and 16 provided on lower ends thereof abut on separate cams fixed to one common cam shaft and a vertical movement is carried out in a predetermined timing according to the cams. The rollers 14, 15 and 16 are pulled toward the cam side with springs 17, 18 and 19 such that they are maintained in the abutment state on the cams.

The right presser member 5, the left presser member 6 and the middle presser member 7 according to the conventional art have been mainly formed cylindrically.

However, the cylindrical members are high workability and might be slightly rotated in the middle of the vertical movement. In this case, the clamping operation or the cutting operation of a cutter is not stabilized so that the operation and function of the presser member are adversely affected. In order to avoid such a situation, it is preferable that a detent mechanism for controlling a rotation should be provided separately. However, there is a problem in that the number of parts is increased or the mechanism is complicated.

Moreover, there have been known square-shaped members. In that case, four faces should be polished or corner portions should be perpendicular. Thus, the square shape needs more precise processings than the circular shape.

SUMMARY OF THE INVENTION

In consideration of the above-mentioned circumstances, it is an object of the present invention to provide a banding packing machine in which a right presser member, a left presser member and a middle presser member can be processed easily and the number of parts is decreased, and furthermore, they can be assembled readily with high precision and are not rotated during sliding.

In order to achieve the above-mentioned object, the present invention provides a banding packing machine in which a tip portion of a band is clamped, is returned from a band feeding side and is tightened and a band superposition portion is melted by a heater. The band feeding side is then cut and bonded in a process of causing a right presser member, a left presser member and a middle presser member arranged rectilinearly opposite to a slide table for freely appearing on a band traveling path constituted on a packing machine body to approach to or separate from each other through an operation of a cam mechanism, wherein a drum portion of at least the middle presser member provided in a central part in the right presser member, the left presser member and the middle presser member has a sectional shape of an almost track including a pair of circular arc portions opposed to each other and a pair of straight portions opposed to each other, and one of ends of each of drum portions in the right presser member and the left presser member which are opposed to the straight portions of the middle presser member is formed rectilinearly.

According to such a structure, it is sufficient that a processing of simply exposing a flat face from a circular shape is carried out. Therefore, the processing of obtaining precision can be performed comparatively easily and a rotation can be prevented without requiring a detent mechanism. Moreover, a distance between the right presser member and the left presser member can be reduced. Consequently, the size of a corresponding slide table can be reduced. Thus, the present invention can contribute to a reduction in the size of the structure.

In the banding packing machine according to the present invention, moreover, the drum portions of the right presser member, the left presser member and the middle presser member can also be accommodated in a support block having an integral structure in which three communicating or overlapping holes corresponding to their shapes are provided.

With such a structure, these three members are guided into the three communicating holes of the support block so that a vertical movement is carried out with a plane contact. Therefore, rotation of the three members is prevented in a reliable manner.

As described above, according to the banding packing machine of the present invention, the left presser member, the middle presser member and the right presser member are vertically moved while coming in contact with each other on a plane basis. Therefore, they are not rotated. Accordingly, it is possible to transmit, with high precision, the operation of the cam mechanism provided to carry out cutting, welding and the like for binding a band. Moreover, the portions of the presser members other than the planar portions are formed like a circular arc. Therefore, in the case in which the whole body is to be formed, it is sufficient that a circular shape is cut. Therefore, high workability can be obtained.

Furthermore, if these three members are accommodated in the support block, they are guided vertically while coming in contact with the planes with the outer peripheral side bound through the support block. Therefore, a possibility that the rotation might be carried out can be lessened still more.

According to the present invention, furthermore, the three members are caused to come in contact with each other on a plane basis. Therefore, it is possible to reduce the assembly width of the whole block including the right presser member, the left presser member and the middle presser member and to reduce a size, and furthermore, to decrease the width of the slide table to abut on the three members.

These objects as well as other objects, features and advantages of the present invention will become more apparent to those skilled in the art from the following description with reference to the accompanying drawings.

DETAILED DESCRIPTION OF THE INVENTION

An embodiment of the present invention will be described below with reference to the drawings.

Figure 1:
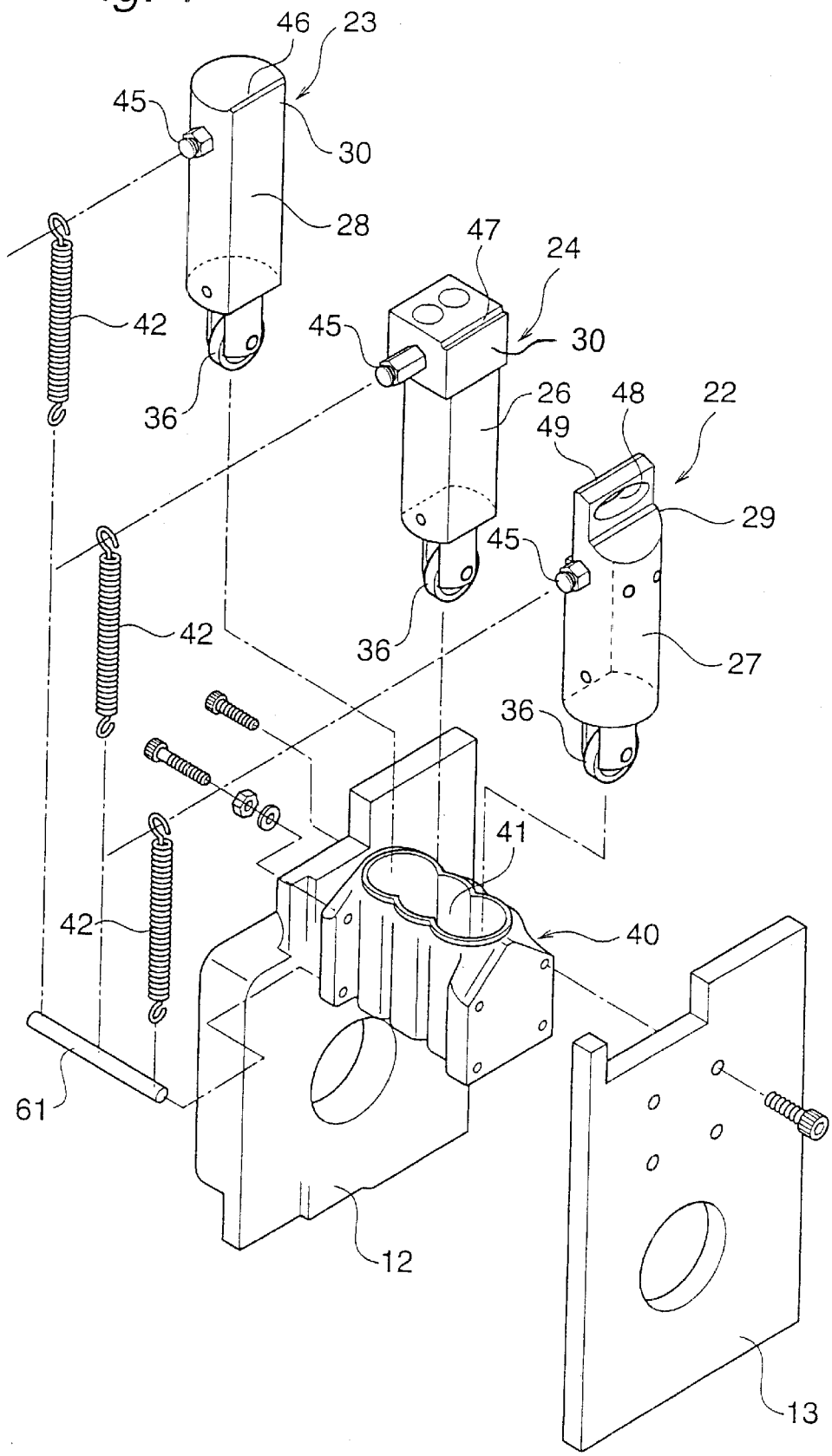
FIG. 1 is an exploded perspective view showing a control portion of a banding packing machine according to an embodiment of the present invention.

FIG. 1 is a view showing the main part of a control portion of a banding packing machine according to the embodiment of the present invention.

Figure 2:
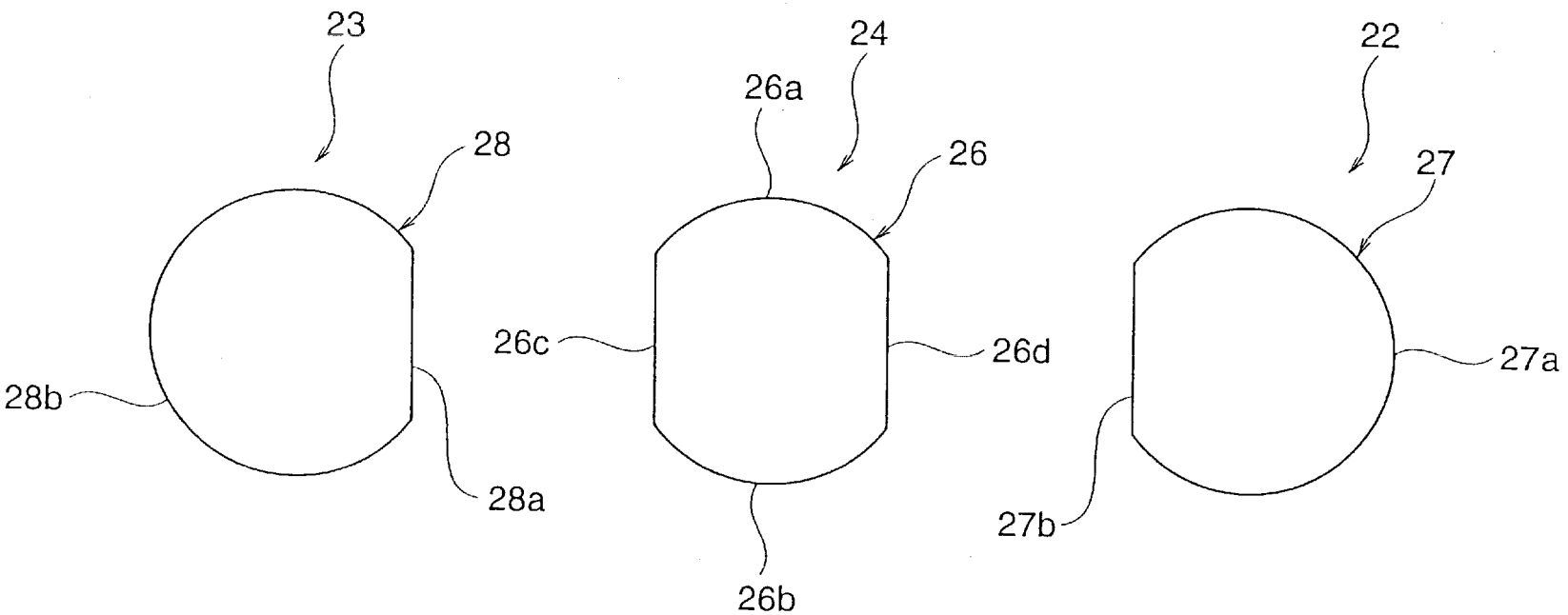
FIG. 2 is a plan view illustrating the external shapes of drum portions of a left presser member, a middle presser member and a right presser member which constitute the control portion in FIG. 1.

In the present embodiment, a right presser member 22, a left presser member 23 and a middle presser member 24 are formed such that drum portions 27, 28 and 26 thereof have external shapes shown in FIG. 2.

More specifically, as shown in FIG. 2, the drum portion 26 of the middle presser member 24 provided in a central part has an external shape including a pair of circular arc portions 26*a* and 26*b* opposed to each other and a pair of straight portions 26*c* and 26*d* opposed to each other, and is wholly formed to have an almost track shape.

On the other hand, the external shape of the drum portion 27 of the right presser member 22 is constituted by a circular arc portion 27*a* and a straight portion 27*b*. The straight portion 27*b* is opposed to the straight portion 26*d* of the middle presser member 24.

Moreover, the external shape of the drum portion 28 of the left presser member 23 is constituted by a straight portion 28*a* and a circular arc portion 28*b*. The straight portion 28*a* is opposed to the straight portion 26*c* of the middle presser member 24.

Figure 3:
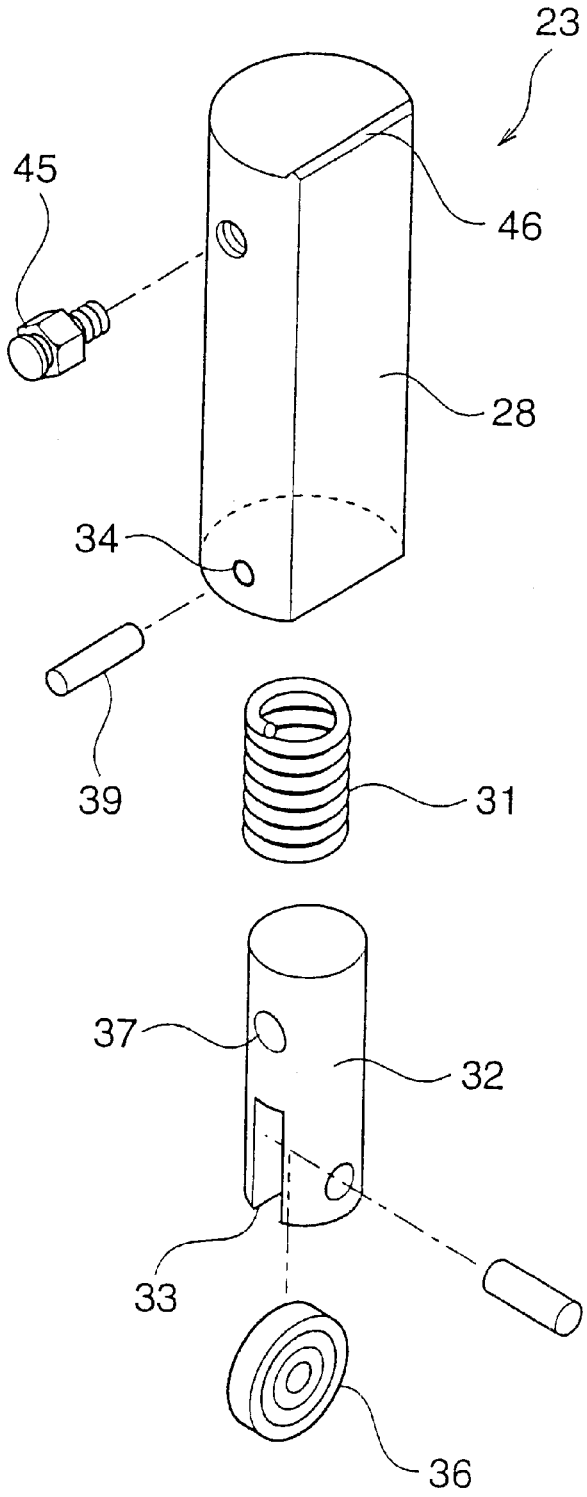
FIG. 3 is an exploded perspective view showing the left presser member according to the embodiment.
Figure 4:
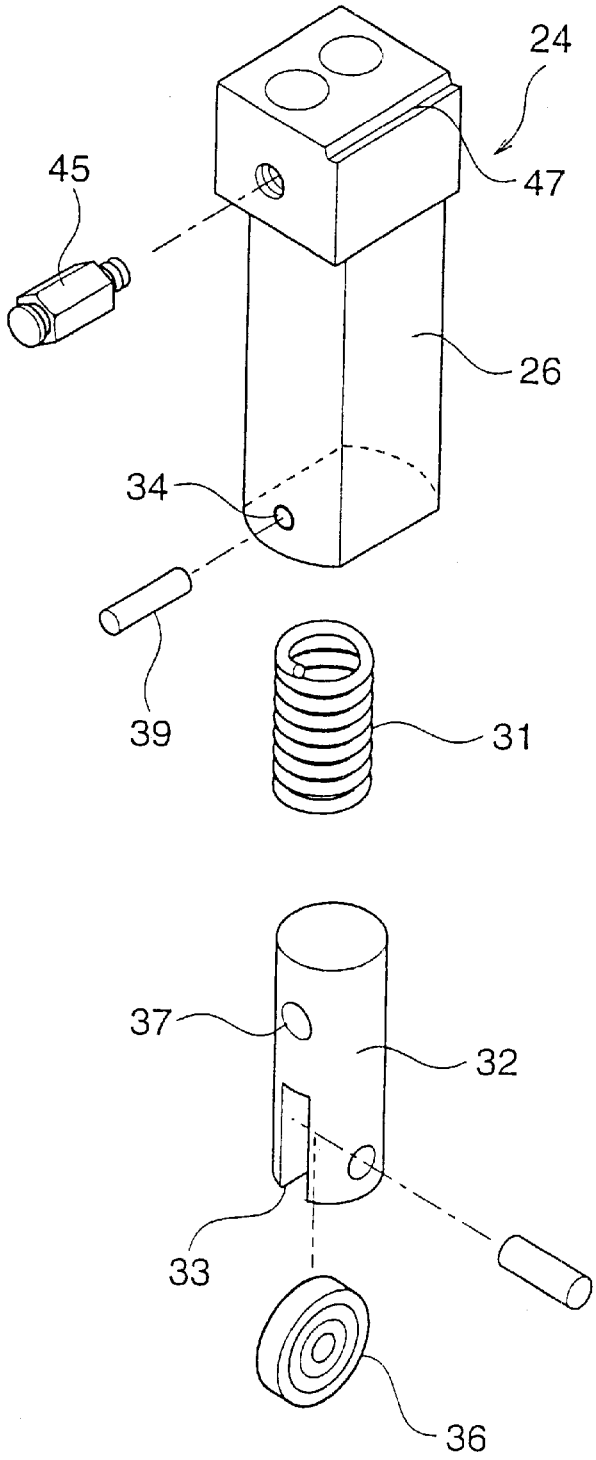
FIG. 4 is an exploded perspective view showing the middle presser member according to the embodiment.
Figure 5:
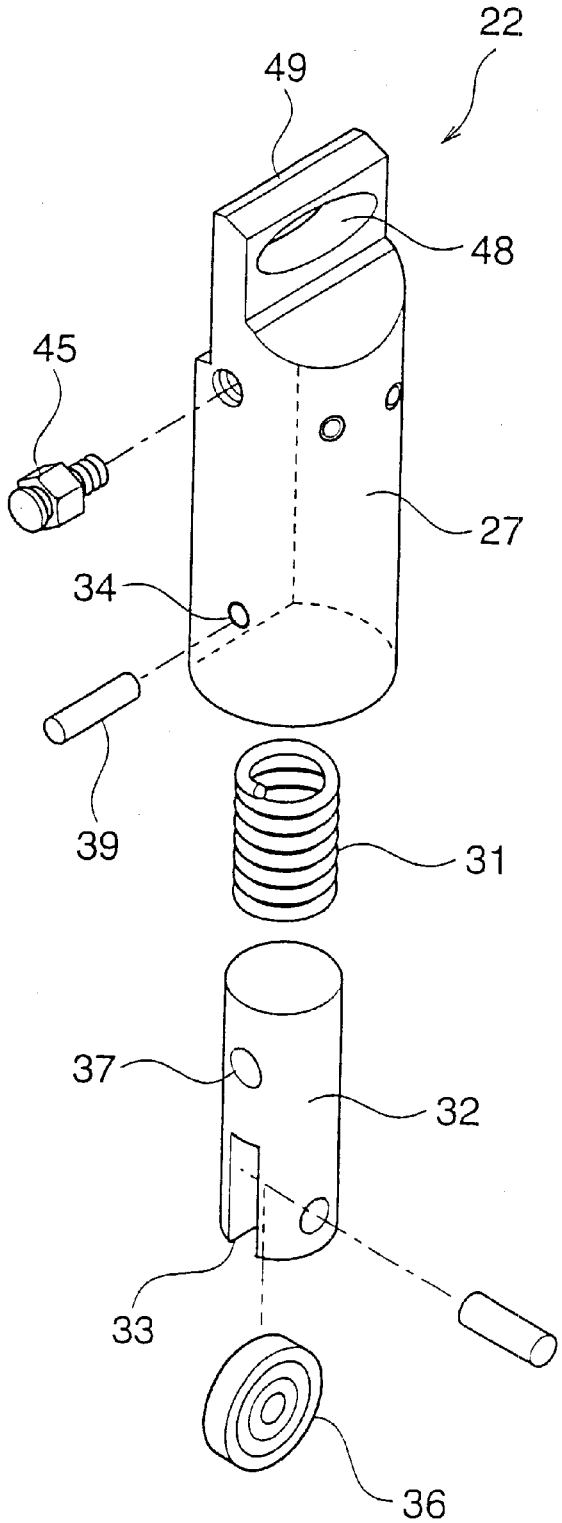
FIG. 5 is an exploded perspective view showing the right presser member according to the embodiment.
Figure 6:
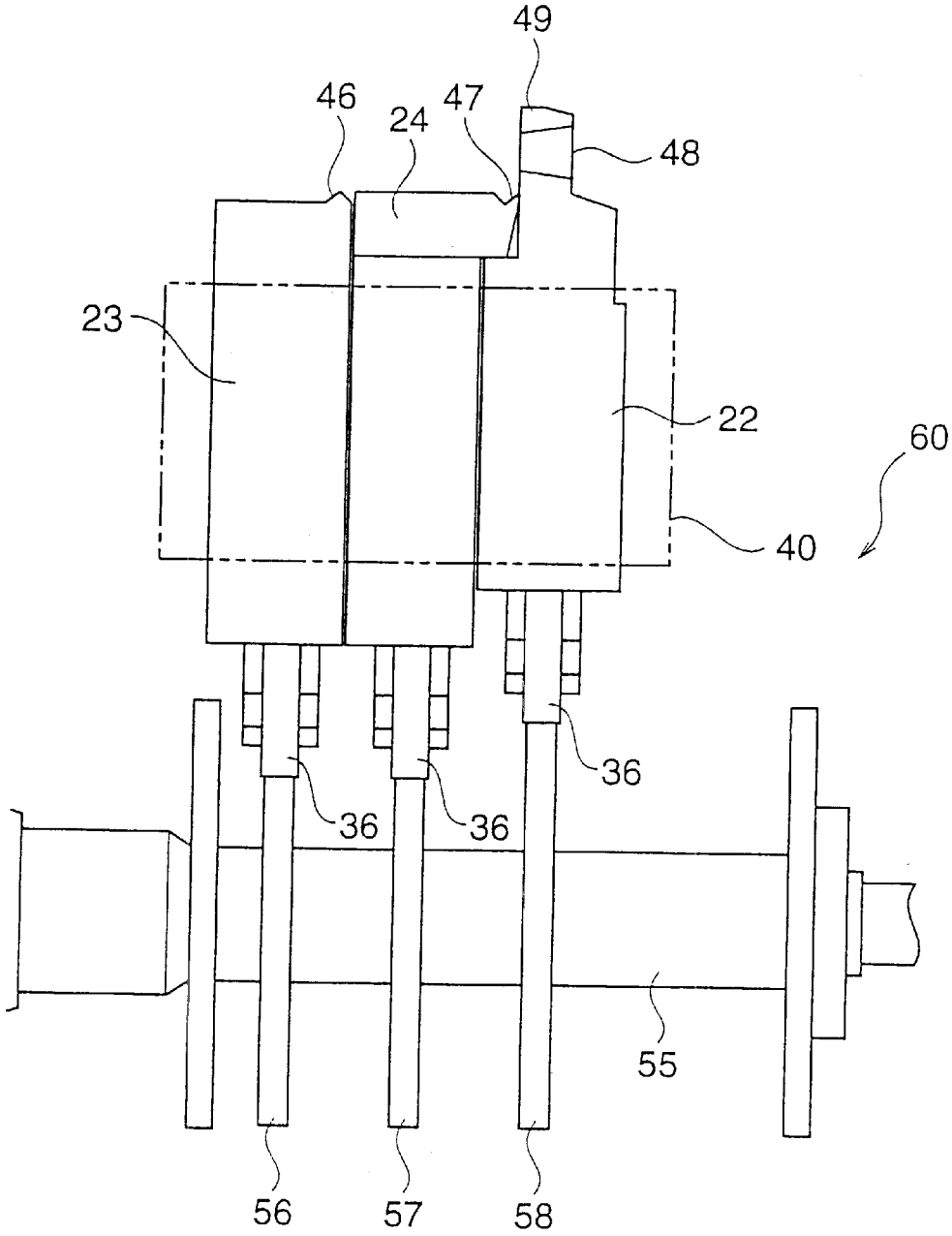
FIG. 6 is a front view showing a cam mechanism according to the embodiment.

The left presser member 23 has a head portion and the drum portion 28 formed integrally. A head portion 29 and the drum portion 27 of the right presser member 22, and a head portion 30 and the drum portion 26 of the middle presser member 24 which are formed separately are attached integrally, respectively. Moreover, the inner parts of the drum portions 28, 26 and 27 have hollow shapes, and a spring 31 is incorporated therein and a plunger 32 is slidably inserted thereunder as shown in FIGS. 3, 4 and 5. A nick portion 33 is formed on the lower end of the plunger 32. A roller 36 to abut on a cam mechanism 60 shown in FIG. 6 is rotatably provided in the nick portion 33.

A pin hole 34 is formed in the drum portions 28, 26 and 27 and an insertion hole 37 is formed on the plunger 32. In a state in which the plunger 32 is inserted in the drum portions 26, 27 and 28, the pin hole 34 is matched with the insertion hole 37 and a pin 39 is then inserted in the holes 34 and 37 such that the plunger 32 does not slip out of the drum portions 26, 27 and 28. The insertion hole 37 has a diameter which is much larger than the diameter of the pin 39. Consequently, the spring 31 is extended by a difference between the diameters, thereby functioning as a cushion.

Figure 11:
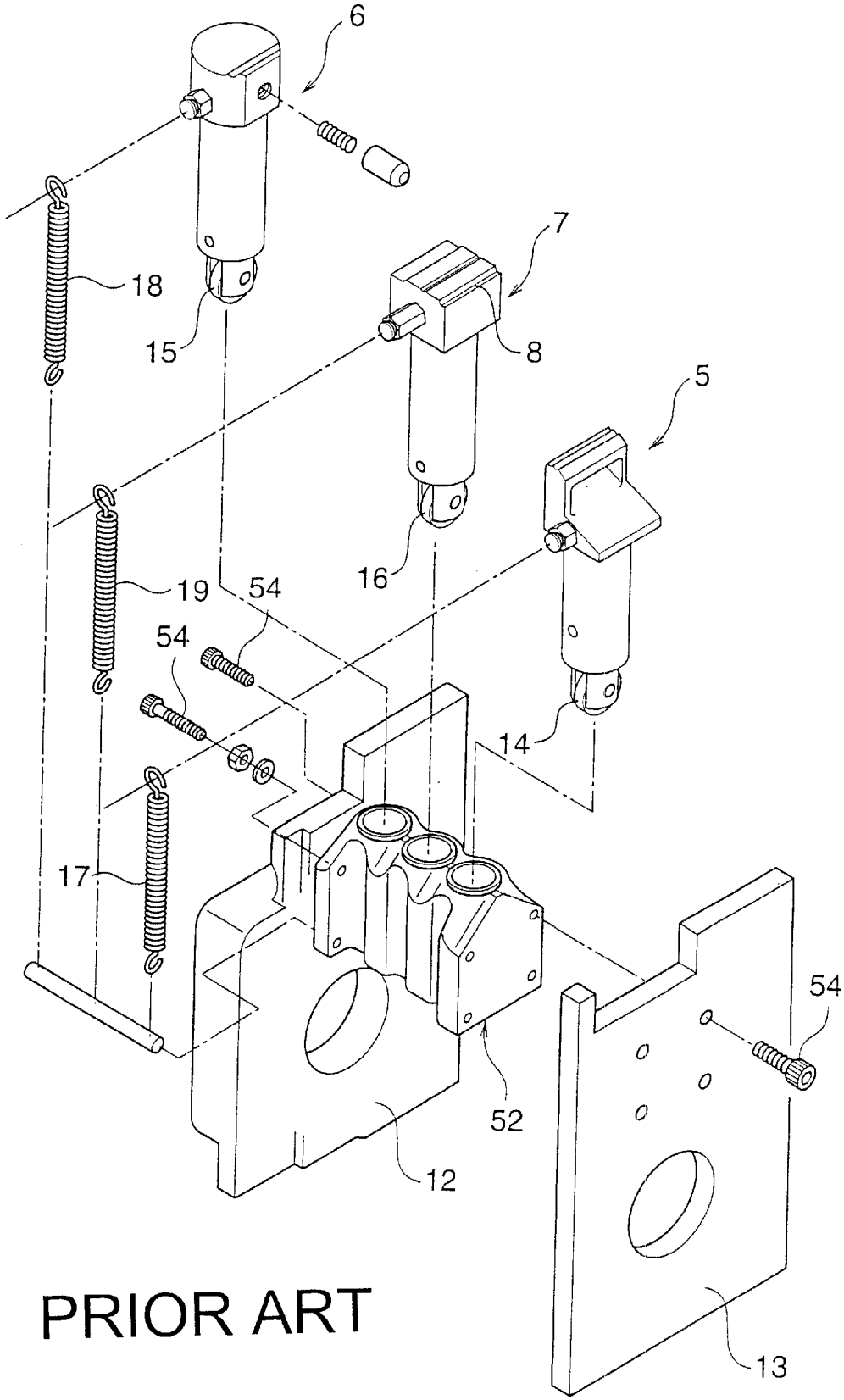
FIG. 11 is a view illustrating the structure of a conventional control portion.

The three members, that is, the left presser member 23, the middle presser member 24 and the right presser member 22 according to the present embodiment are formed as described above and are similar to those in the conventional art in that they are supported on a pair of fixed plates 12 and 13 in the same manner as shown in FIG. 11.

Accordingly, when the roller 36 is moved vertically in a predetermined timing in conformity with a cam of the cam mechanism, the left presser member 23, the middle presser member 24 and the right presser member 22 are vertically moved while planes thereof slidably contact the planes abutting each other. In this respect, the present embodiment is greatly different from the conventional example.

In the present embodiment, furthermore, these three members 23, 24 and 22 are accommodated in a support block 40 having an integral structure shown in FIG. 1.

The support block 40 includes three communicating or overlapping holes 41 having sectional shapes corresponding to the shapes of the drum portions 28, 26 and 27. The drum portions 28, 26 and 27 are slidably inserted in portions corresponding to the three communicating holes 41. Accordingly, the left presser member 23, the middle presser member 24 and the right presser member 22 are vertically moved in the support block 40 while the planes come into contact with each other. Accordingly, the three members cannot rotate during vertical movement imposed by the cam. In such a state that the drum portions 28, 26 and 27 are inserted in the support block 40, the roller 36 attached to the plunger 32 is set to be protruded downward from the three communicating holes 41. Thus, the roller 36 protruded from the three communicating holes 41 directly abut on cams 56, 57 and 58 fixed to a cam shaft 55 of the cam mechanism 60 shown in FIG. 6 such that the rollers 36 do not separate from the respective cams 56, 57 and 58.

In FIG. 1, the reference numeral 45 denotes a spring holder provided on side surfaces of the presser members 23, 24 and 22. A spring 42 is caught between the spring holder 45 and a shaft 61 on the body side so that the roller 36 reliably comes into contact with the cams 56, 57 and 58 and does not separate therefrom. Moreover, the reference numeral 46 denotes a non-slip portion provided in the left presser member 23. A band B is held by the non-slip portion 46. The reference numeral 47 denotes a cutting blade provided in the middle presser member 24. The band B is cut between the cutting blade 47 and the right presser member 22. The reference numeral 48 denotes a guide hole provided in the right presser member 22 for inserting the band B therethrough, and the reference numeral 49 denotes a non-slip portion provided in the right presser member 22.

While the control portion in the banding packing machine according to the present embodiment has the above-mentioned structure, the function thereof will be described below. The same elements as those in FIG. 11 have the same reference numerals and description will be given.

Figure 7:
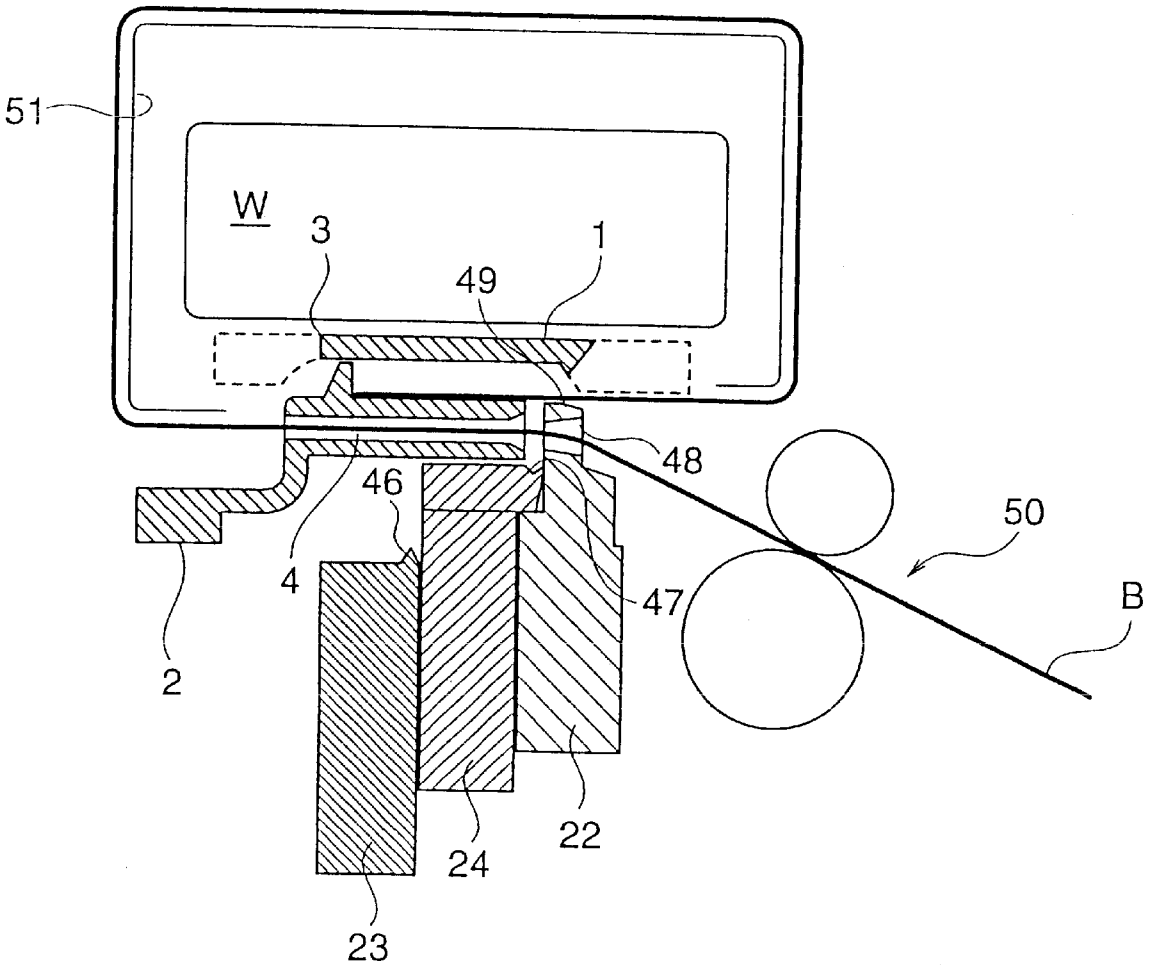
FIG. 7 is a view illustrating the initial state of the control portion when banding is to be carried out.
Figure 8:
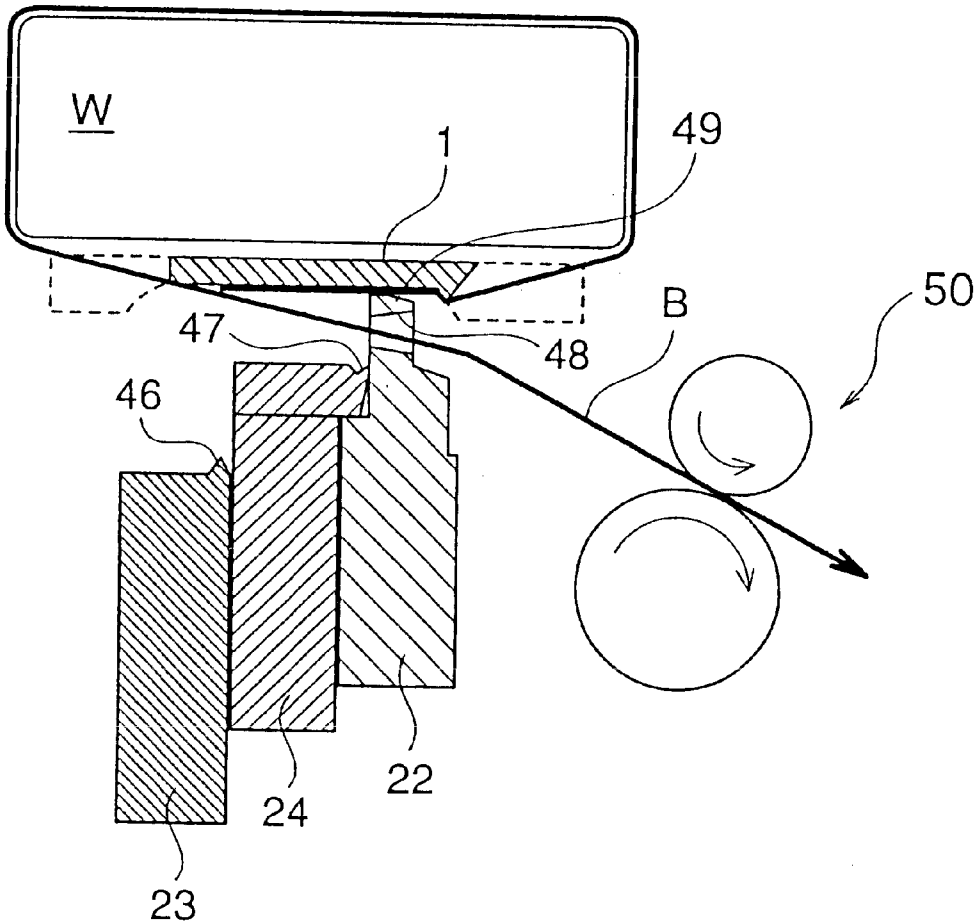
FIG. 8 is a view illustrating a state in which a band is tightened when the banding is to be carried out.

As shown in FIG. 7, a band guide 2 is positioned on the lower surface of a slide table 1. In this state, the band B is inserted into a guide hole 48 of the right presser member 22 and a guide passage 4 of the band guide 2 by the driving force of a band feeding roller 50. When the tip of the band B abuts on a stopper 3, the right presser member 22 is lifted to interpose the band B between the non-slip portion 49 and the slide table 1 as shown in FIG. 8. When the band B is thus interposed completely, the band guide 2 is caused to retreat from a band traveling path.

Figure 9:
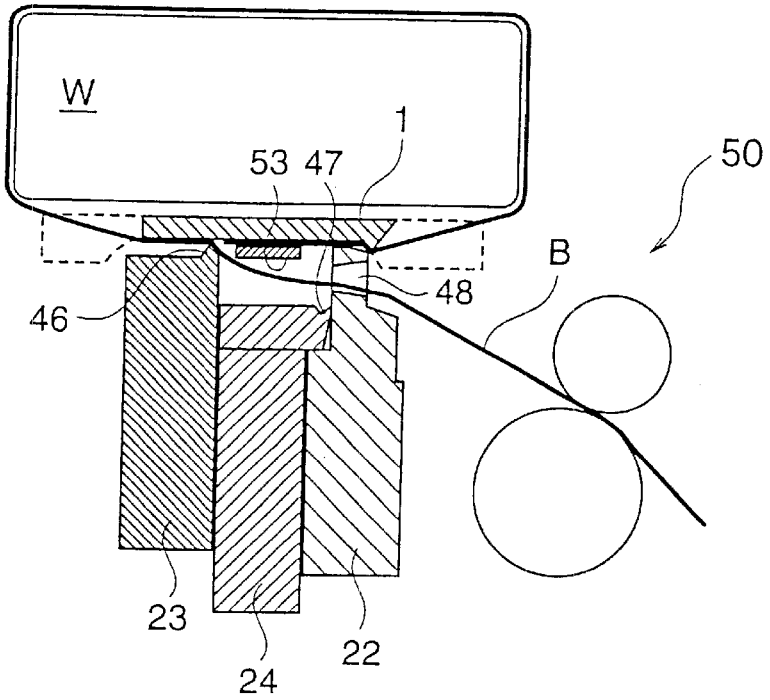
FIG. 9 is a view illustrating a state of welding in which the banding is to be carried out.
Figure 10:
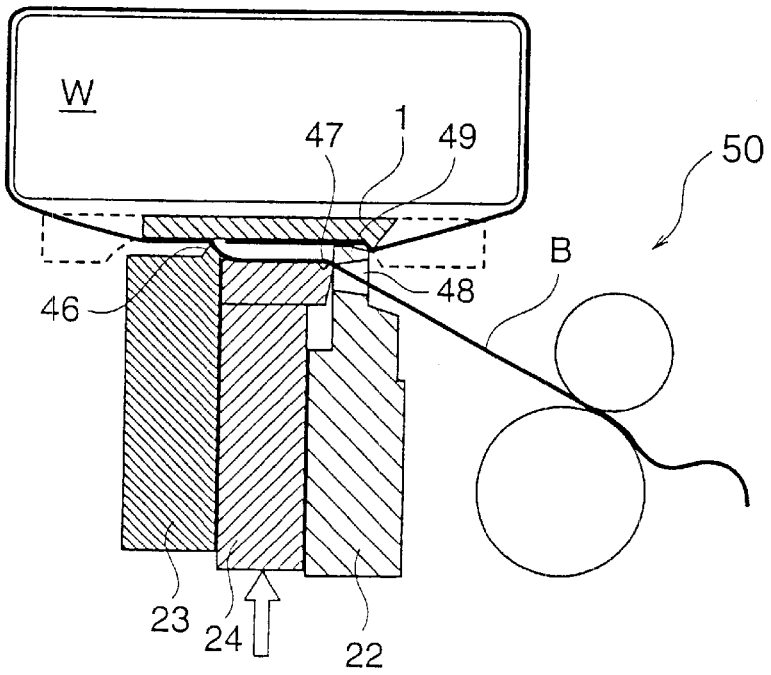
FIG. 10 is a view illustrating a state of band cutting in which the banding is to be carried out.

After the band guide 2 is caused to retreat from the band traveling path, the band feeding roller 50 is reversed in directions of arrows in FIG. 8 to pull the band B. Consequently, the band B is forcibly removed from a band guide arch 51 and is wound onto an object W to be packed. When the band B is wound onto the object W to be packed, band B is further pulled and tightened. After the band B is thus tightened, the left presser member 23 is moved to an uppermost position to interpose the binding rear end side of the band B between the non-slip portion 46 of the left presser member 23 and the slide table 1 as shown in FIG. 9. In this state, the binding tip portion of the band B and the binding rear end portion are opposed to each other with a space maintained vertically. A heater 53 is inserted in the space as shown in FIG. 9, thereby melting the surface of the band B. When the surface of the band B is molten, the middle presser member 24 is lifted to push the molten portion thereagainst and is bonded thereto as shown by the arrow in FIG. 10. At this time, the cutting blade 47 of the middle presser member 24 cuts the band B together with the right presser member 22.

Thus, a series of banding works are carried out based on the operation of the cam mechanism 60 shown in FIG. 6 and the banding on the object W to be packed is ended.

In the present embodiment, thus, both ends of the middle presser member 24 are formed rectilinearly, that is, on a plane and one of the ends of the left presser member 23 and one of the ends of the right presser member 22 which are opposed to the respective rectilinear end are formed rectilinearly, and the hole of the support block 40 accommodating them is constituted by one continuous hole. Therefore, these three members are vertically moved while the planes thereof come into contact with each other in the hole of the support block 40. Since the members are thus moved vertically while coming into contact with each other on the planes, they are not rotated on the way of the vertical movement. Consequently, the motion of the cam mechanism 60 through the cam shaft 55 and the cams 56, 57 and 58 can be transmitted accurately to the bound portion of the band B. Moreover, it is sufficient that a straight line is formed by working a circle in these processings. Therefore, workability can be enhanced.

Moreover, the assembly width of the right presser member 22, the left presser member 23 and the middle presser member 24 can be reduced by virtue of the area of material removed from the presser members in forming the planar guide surfaces. Therefore, the width of the slide table 1 can be reduced.

While the embodiment of the present invention has been described above, the present invention is not restricted to the above-mentioned embodiment. Although the left presser member 23, the middle presser member 24 and the right presser member 22 are accommodated in the support block 40 in the above-mentioned embodiment, the support block 40 is not indispensable.

Moreover, it is a matter of course that the present invention can be applied to both an automatic packing machine and a semi-automatic packing machine.

Numerous modifications and alternative embodiments of the present invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A banding packing machine having left, right and middle presser members which are sequentially moved vertically by a cam mechanism, wherein a tip portion of a band is clamped, returned from a band feeding side and is tightened and a band portion superpositioned above the tip portion is melted by a heater and the band feeding side is cut and bonded to the tip portion as the molten portion solidifies, the improvement comprising:

the left, right and middle presser members having drum portions having a circular cylindrical shape, wherein the drum portions of the right and left presser members each have a flat, planar surface formed thereon, extending substantially parallel with a longitudinal axis of each of the presser members, wherein the drum portion of the middle presser member has a pair of flat, planar surfaces formed thereon, extending parallel to each other and parallel to a longitudinal axis of the middle presser member, and wherein the planar surfaces of the right and left presser members slidably engage the respective pair of planar surfaces of the middle presser member for sequential vertical movement caused by said cam mechanism, whereby relative rotative movement of the presser members is prevented.

2. The band packing machine according to claim 1, wherein the drum portions of the right presser member, the left presser member and the middle presser member are slidably accommodated in a support block having an integral structure including three overlapping holes which correspond to the cylindrical shapes and planar flat surfaces of the presser members.

* * * * *